US011243048B1

(12) United States Patent
Bryan

(10) Patent No.: US 11,243,048 B1
(45) Date of Patent: Feb. 8, 2022

(54) FIREARM SIGHT

(71) Applicant: Kraig Bryan, Miami, FL (US)

(72) Inventor: Kraig Bryan, Miami, FL (US)

( * ) Notice: Subject to any disclaimer, the term of this patent is extended or adjusted under 35 U.S.C. 154(b) by 0 days.

(21) Appl. No.: 16/662,217

(22) Filed: Oct. 24, 2019

Related U.S. Application Data

(60) Provisional application No. 62/749,779, filed on Oct. 24, 2018.

(51) Int. Cl.
*F41G 1/35* (2006.01)
*F41G 1/36* (2006.01)

(52) U.S. Cl.
CPC *F41G 1/35* (2013.01); *F41G 1/36* (2013.01)

(58) Field of Classification Search
CPC ..... F41G 1/32; F41G 1/35; F41G 1/36; F41G 1/473; F41G 1/52; F41G 3/2616; F41G 3/2622
USPC ..... 42/114, 117, 132
See application file for complete search history.

(56) References Cited

U.S. PATENT DOCUMENTS 3,098,303 A 7/1963 Piisk
3,914,873 A * 10/1975 Elliott, Jr ..... F41G 1/345 42/132
4,713,889 A * 12/1987 Santiago ..... F41C 33/0227 224/246
4,934,086 A 6/1990 Houde-Walter
5,392,550 A 2/1995 Moore et al.
5,735,070 A * 4/1998 Vasquez ..... F41A 9/62 42/1.02
5,924,234 A 7/1999 Bindon et al.
6,216,351 B1 4/2001 Flubacher et al.
6,571,504 B2 * 6/2003 Carlson ..... F41G 1/345 42/132
6,581,317 B1 6/2003 Slates
6,640,482 B2 11/2003 Carlson
6,978,569 B2 * 12/2005 Williamson, IV ..... F41G 1/44 42/132
7,333,270 B1 2/2008 Pochapsky et al.
7,346,400 B2 * 3/2008 Cross ..... F41G 1/345 42/119
7,451,566 B1 11/2008 Price
7,562,486 B2 7/2009 LoRocco
7,574,810 B1 8/2009 LoRocco
7,676,137 B2 3/2010 Schick
(Continued)

FOREIGN PATENT DOCUMENTS

WO WO-2020096728 A1 * 5/2020 ..... F41G 11/003

*Primary Examiner* — Bret Hayes
(74) *Attorney, Agent, or Firm* — John Rizvi; John Rizvi, P.A.—The Patent Professor

(57) ABSTRACT

A firearm sight which facilitates ease and accuracy in aiming a firearm may include a sight housing configured to be attached to a firearm. The sight housing may include a front housing end and a rear housing end. At least one power source and a light emitter which electrically interfaces with the power source may be provided in the sight housing. A light transmission compartment may be provided in the sight housing and disposed in light-receiving communication with the light emitter. The light transmission compartment may have a light emission end at the rear housing end of the sight housing. A light transmission medium may be provided in the light transmission compartment to emit light from the light emitter through the light emission end of the light transmission compartment.

14 Claims, 7 Drawing Sheets

(56) References Cited

U.S. PATENT DOCUMENTS

| | | | | |
|---|---|---|---|---|
| 7,676,981 | B2 | 3/2010 | Buckingham et al. | |
| 7,877,921 | B1 | 2/2011 | Stenton | |
| 7,946,075 | B2 | 5/2011 | Nasef | |
| 8,189,967 | B1 | 5/2012 | Olson | |
| 8,230,637 | B2 | 7/2012 | Lamb | |
| 8,869,784 | B2 | 10/2014 | LoRocco et al. | |
| 8,879,146 | B2 | 11/2014 | LoRocco et al. | |
| 9,046,320 | B2 | 6/2015 | Keng et al. | |
| 9,903,686 | B2 | 2/2018 | Maynard | |
| 10,088,275 | B1 * | 10/2018 | Warren | F41G 1/345 |
| 2006/0048432 | A1 * | 3/2006 | Staley, III | F41G 1/38 42/122 |
| 2012/0151816 | A1 * | 6/2012 | Kleck | F41G 1/30 42/132 |
| 2014/0317989 | A1 | 10/2014 | Lee | |
| 2015/0153136 | A1 | 6/2015 | Howe et al. | |
| 2016/0282076 | A1 * | 9/2016 | Valdez | F41A 33/02 |
| 2017/0025233 | A1 * | 1/2017 | Prestwich | F41G 11/00 |
| 2018/0195836 | A1 * | 7/2018 | Matthews | F41G 1/36 |
| 2018/0347949 | A1 * | 12/2018 | Lupher | G01S 7/487 |
| 2020/0109926 | A1 * | 4/2020 | Mata | F41H 13/0025 |

* cited by examiner

FIREARM SIGHT

CROSS-REFERENCE TO RELATED APPLICATION

This application claims the benefit of U.S. Provisional Patent Application Ser. No. 62/749,779, filed on Oct. 24, 2018, which is incorporated by reference herein in its entirety.

FIELD OF THE INVENTION

The present invention relates generally to firearms, and more particularly, to a firearm sight which utilizes a light emitter that emits light viewed by a firearm shooter to facilitate ease and accuracy in aiming a firearm.

BACKGROUND OF THE INVENTION

Conventional sighting arrangements on firearms such as pistols and the like may include a single post on the front-end portion of the firearm barrel. A notched sighting flange may extend from a rear-end portion of the firearm barrel. A shooter may aim the firearm at a target by initially pointing the firearm at the target, aligning the post with the target and then aligning the notch in the sighting flange with the post. This method of aiming the firearm at the target, however, may be time-consuming and inaccurate.

Some shooters may use various types of lights or luminescent elements to assist in aiming a firearm at a target. Some of these types of sights may require ambient light to operate effectively. For example, fiber optic sights operate by gathering ambient light at a light-gathering element or aperture in the fiber optic sight and transmitting the gathered ambient light along the length of a fiber optic fiber comprised in the fiber optic sight, providing the sight with an illuminated point or spot. However, because the quality and/or quantity of ambient light in different environments may vary and fiber optic sights are generally dependent on ambient light, fiber optic sights may be ineffective in many applications, such as in dark conditions or in low-lighting environments.

In some applications, in order to compensate an insufficient ambient lighting, fiber optic sights may utilize an artificial light source or light-emitting element such as one or more light-emitting diodes (LEDs) or tritium gas-filled glass capsules having inner surfaces coated with phosphor. The light source or light-emitting element may be disposed adjacent to the external surfaces of the fiber optic fibers to provide a source of aiming light in low-lighting environments. However, difficulty can be encountered in properly positioning the light-gathering element and the light-emitting element in the correct proximity to achieve sufficient brightness while aiming the firearm.

Also known are conventional reflex sights, which may utilize a partially reflective lens and a light source which projects light onto the lens, forming a dot that is superimposed on a target as the target is viewed through a sight. Responsive to inadvertent movement of the firearm, however, the dot is prone to excessive movement on the target, often rendering it difficult for the shooter to accurately aim the firearm at the target.

Accordingly, there is an established need for a firearm sight which solves at least one of the aforementioned problems. For example, there remains a need for a firearm sight which can allow a shooter to easily and accurately aim a firearm in both illuminated and non-illuminated environments.

SUMMARY OF THE INVENTION

The present invention is directed to a firearm sight which utilizes a light emitter that emits light responsively to a sensor detecting a motion, change in position or change in orientation of the firearm sight, as the user moves the firearm. The sensor allows to automatically activate the light emitter, thus facilitating use of the firearm sight and allowing for an easier and more accurate aim in virtually any environment. The light emitter may include a visible-light emitter and/or an infrared-light emitter.

In a first implementation of the invention, a firearm sight for facilitating ease and accuracy in aiming a firearm comprises a sight housing configured to be attached to a firearm. The sight housing includes a front housing end and a rear housing end configured to be oriented towards a front end and a rear end of the firearm, respectively. The firearm sight further includes at least one light emitter, at least one sensor and at least one power source, all of which are carried by the sight housing. The at least one sensor is configured to detect at least one of a motion, a change in position or a change in orientation of the sight housing, and thus of the firearm to which the sight housing is attached. The at least one light emitter is switchable to an activated status responsively to the at least one sensor detecting a motion, a change in position or a change in orientation of the sight housing. In the activated status, the at least one light emitter is powered by the at least one power source and emits a light outside the sight housing.

In a second aspect, the at least one light emitter may be arranged inside the sight housing.

In another aspect, light emitted by the at least one light emitter may be emitted outside of the sight housing through the front housing end.

In another aspect, light emitted by the at least one light emitter may be emitted outside of the sight housing through the rear housing end.

In another aspect, the at least one sensor may be arranged inside the sight housing.

In yet another aspect, the at least one power source may be arranged inside the sight housing.

In another aspect, the at least one light emitter may include at least one infrared-light emitter.

In another aspect, the at least one light emitter may include at least one visible-light emitter.

In another aspect, the firearm sight can further include a light transmission medium extending between the at least one visible-light emitter and the rear end of the sight housing.

In yet another aspect, the light transmission medium can further extend between the at least one visible-light emitter and the front end of the sight housing.

In another aspect, the sight housing can include a power source compartment housing the at least one power source, a light emitter compartment housing the at least one light emitter, and a light transmission compartment housing the light transmission medium.

In another aspect, the compartments may be arranged in a vertically-stacked configuration, with the power source compartment arranged closest to the firearm, the light transmission compartment arranged farthest to the firearm, and the light emitter compartment arranged between the power source compartment and the light transmission compartment.

In another aspect, the at least one light emitter may be switchable to a deactivated status responsively to the at least one sensor not detecting a motion, a change in position or a change in orientation of the sight housing for a predetermined period of time. In the deactivated status, the at least one light emitter does not emit light.

In yet another aspect, the predetermined period of time may be greater than zero.

In another aspect, the firearm sight may be configured such that the light emitter remains in the deactivated status as long as the at least one sensor does not detect a motion, a change in position or a change in orientation of the sight housing. Once the at least one sensor detects a motion, a change in position or a change in orientation of the sight housing, the firearm sight may enter an awake status. The at least one light emitter may be switchable to the activated status when the at least one sensor of the firearm sight in the awake status detects a predetermined motion, predetermined change in position or predetermined change in orientation of the sight housing.

In another aspect, the firearm sight can further include a sight mount bracket carrying the sight housing and configured to mount the firearm sight on the firearm.

In another aspect, the firearm sight can further include a user-operable switch configured to switch the at least one light emitter to the activated status responsively to manual operation of the user-operable switch.

In yet another aspect, the firearm sight may further include a user-operable control configured to adjust a brightness of the at least one light emitter responsively to manual operation of the user-operable control.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a firearm sight which utilizes a light emitter that emits light viewed by a firearm shooter to facilitate ease and accuracy in aiming a firearm.

Figure 1:
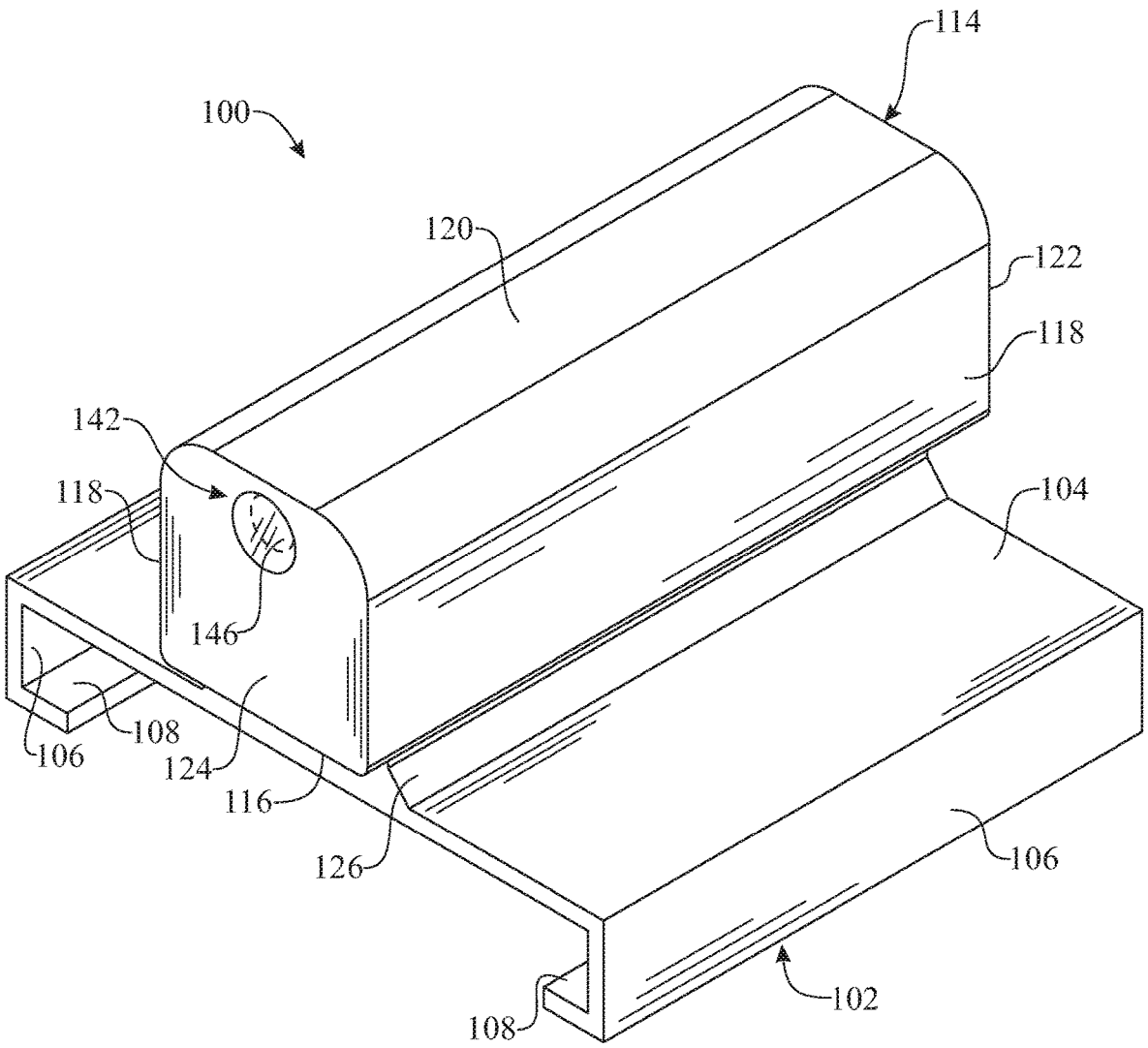
FIG. 1 presents a top rear perspective view of a firearm sight in accordance with a first illustrative embodiment of the present invention.
Figure 2:
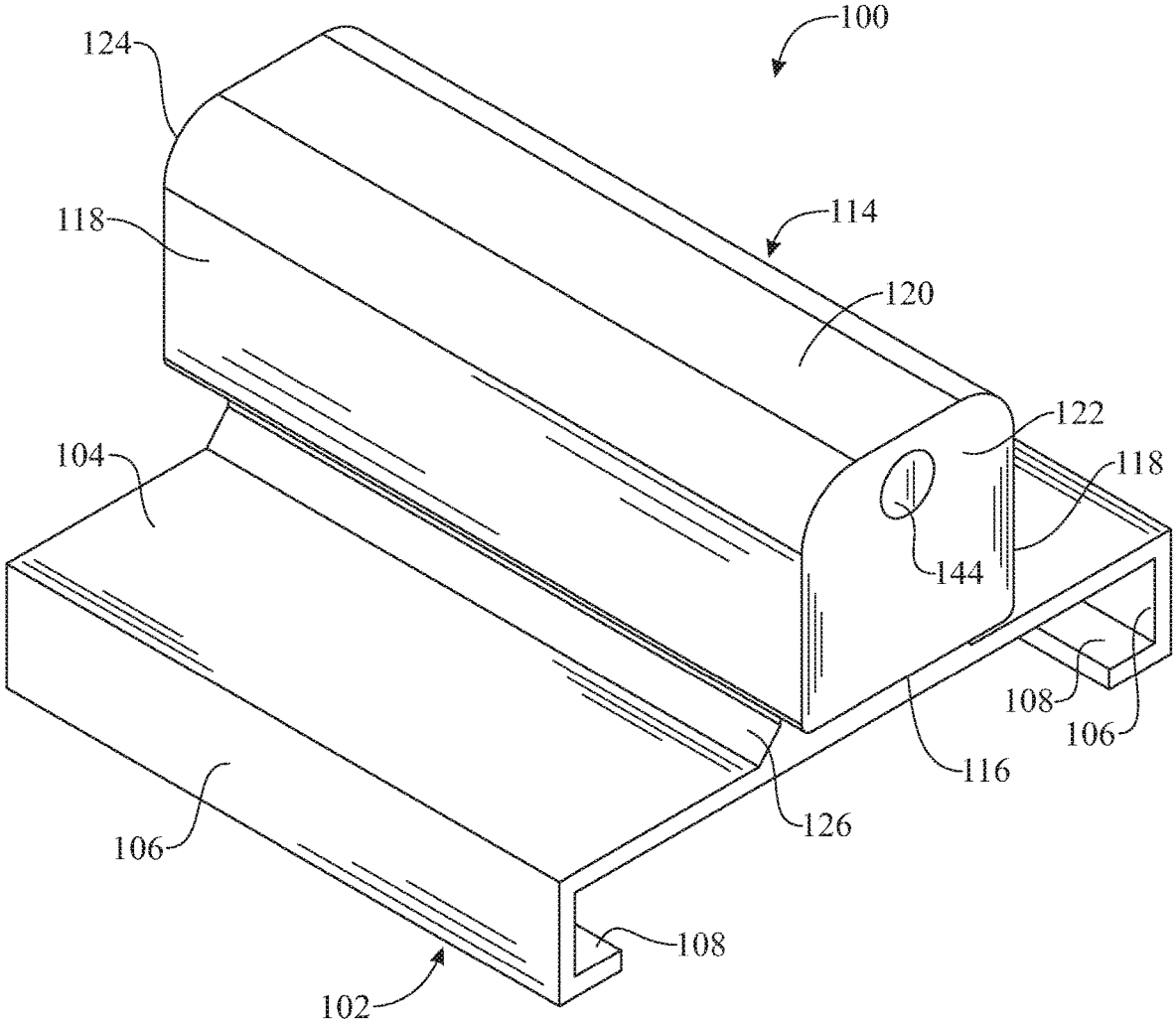
FIG. 2 presents a top front perspective view of the firearm sight of FIG. 1.
Figure 3:
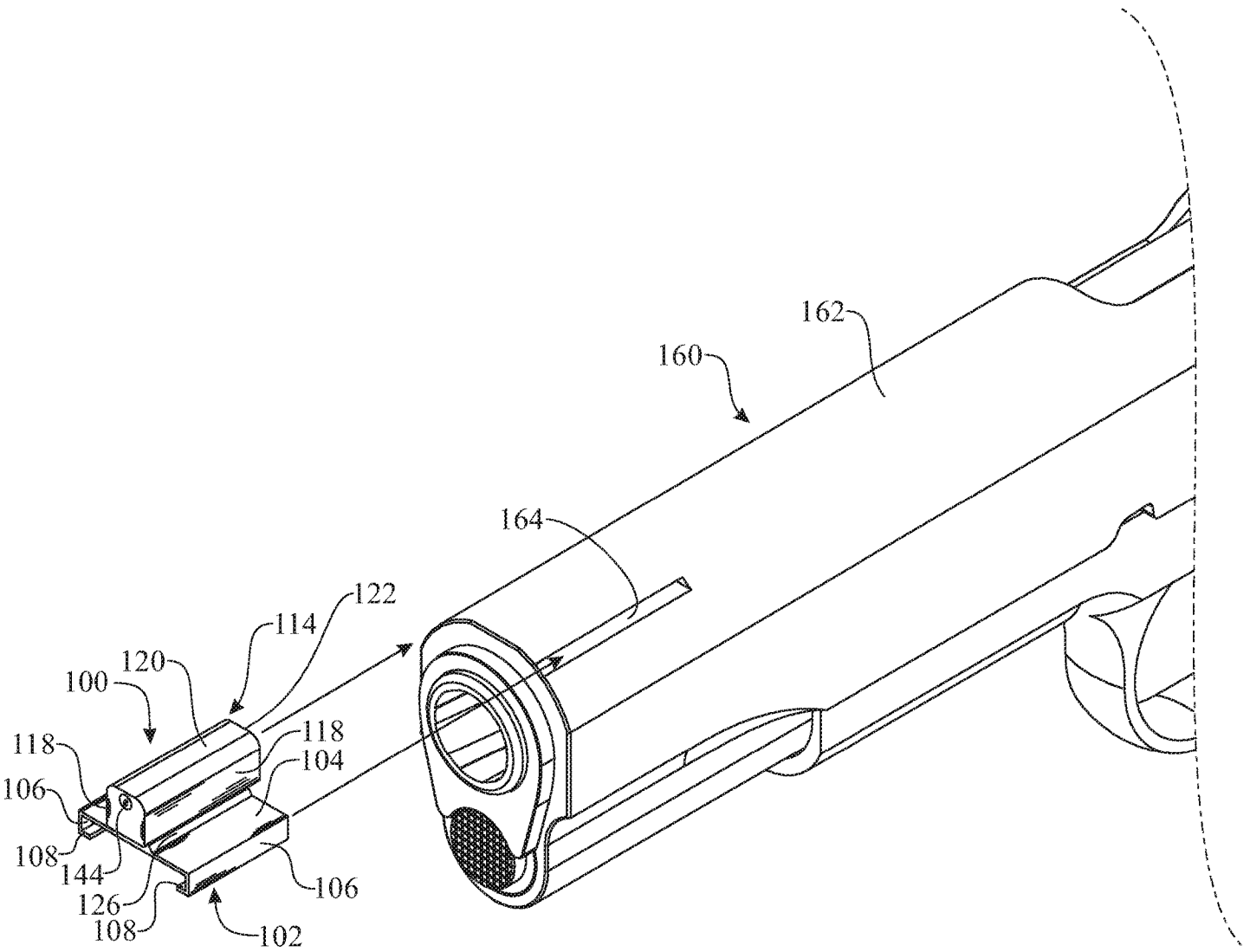
FIG. 3 presents an exploded front perspective view illustrating attachment of the firearm sight of FIG. 1 to a firearm.
Figure 4:
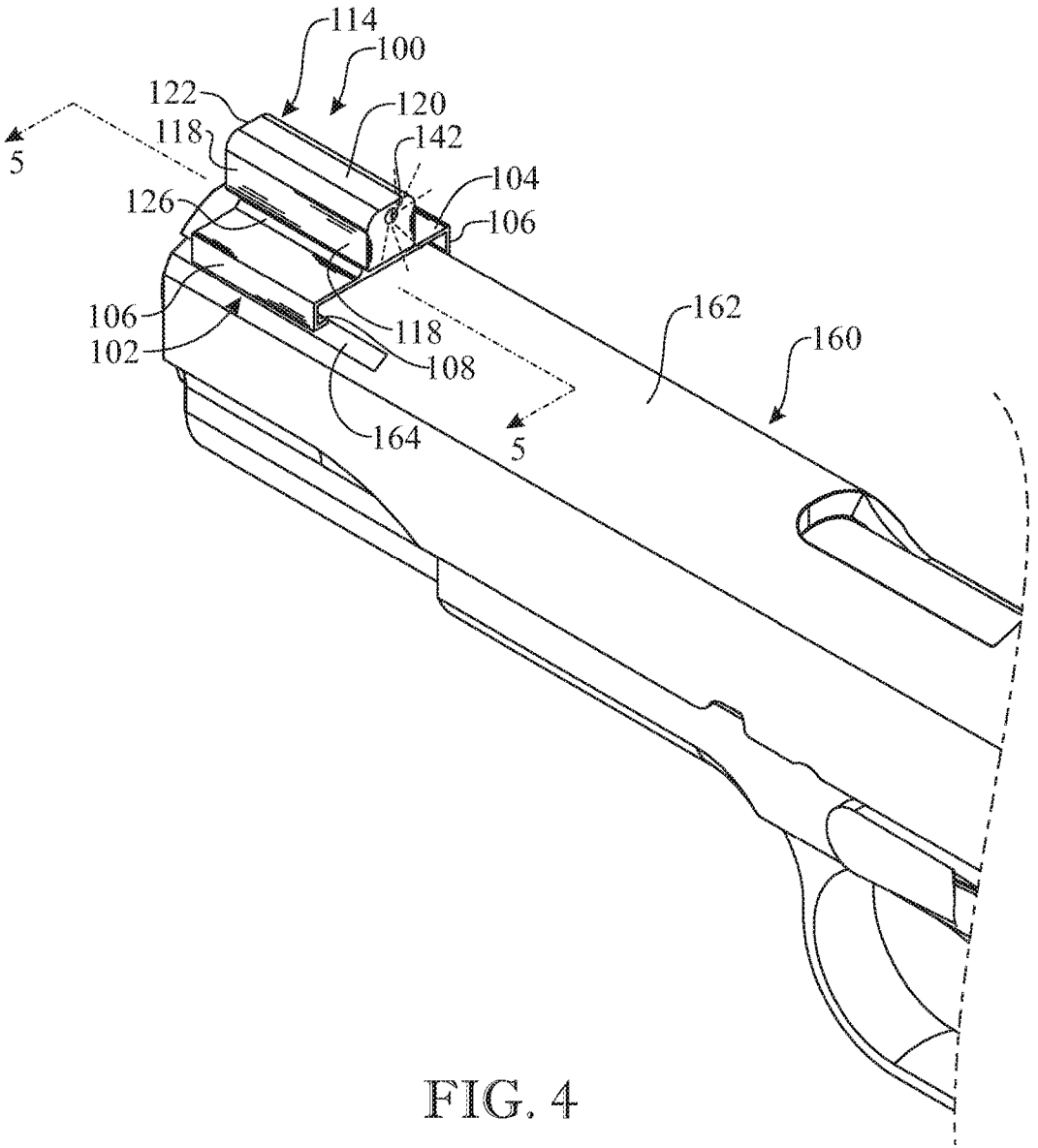
FIG. 4 presents a rear perspective view of the firearm sight of FIG. 1 attached to a firearm.

Referring initially to FIGS. 1-5 of the drawings, a first illustrative embodiment of the firearm sight is generally indicated by reference numeral 100. As illustrated in FIGS. 3 and 4 and will be hereinafter described, the firearm sight 100 may be suitably configured to be mounted on a firearm 160; for instance, the firearm sight 100 may be mounted on a firearm slide, a firearm barrel 162, or other applicable part of a firearm. In some applications, such as the depicted application, the firearm 160 may be a pistol. In other applications, the firearm 160 may include a rifle or other firearm.

Figure 5:
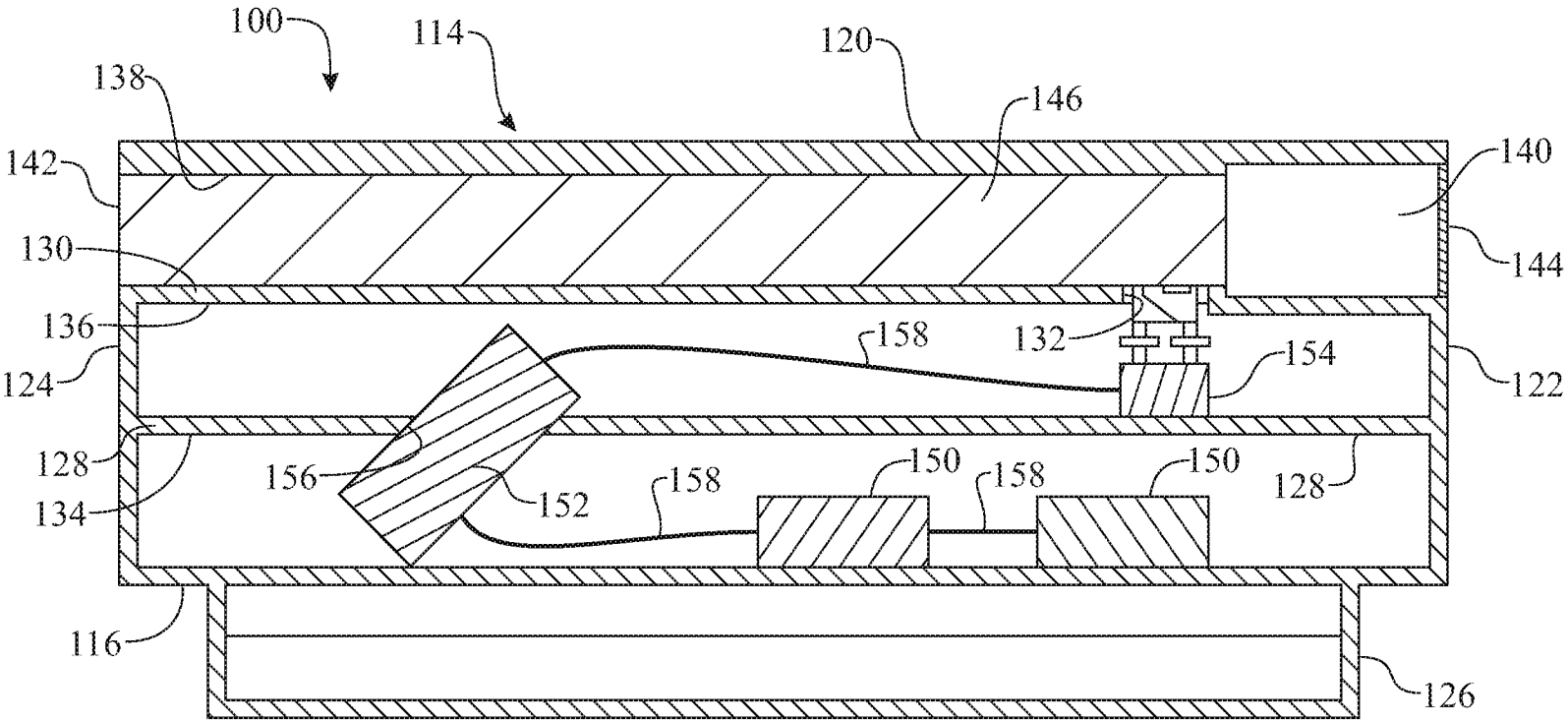
FIG. 5 presents a cross-sectional side elevation view of the firearm sight of FIG. 1, showing internal components of the sight, wherein the cross section has been carried out along section plane 5-5 indicated in FIG. 4.

As shown in FIG. 5 and will be hereinafter described, the firearm sight 100 may utilize a light emitter 154 that emits a beam of visible light which is viewed by a firearm shooter (not illustrated) to assist the firearm shooter in aiming the firearm 160. In some embodiments, the firearm sight 100 may include at least one sensor 152 which may be programmed or configured to activate or energize the light emitter 154. For instance, the at least one sensor 152 may include a motion or position sensor, such as, but not limited to, at least one accelerometer which is able to detect changes in the motion, position or orientation of the firearm sight 100 (e.g., of a sight housing 114 that will be described in detail hereinafter). The motion or position sensor may be programmed or configured to activate or energize the light emitter 154 in the event that the sensor 152 detects motion or a change in position of the firearm sight 100. In different embodiments of the invention, the sensor 152 may be programmed or configured to activate or energize the light emitter 154 when any motion of the firearm 160 is subsequently detected. For example and without limitation, in some embodiments, the sensor 152 may be programmed or configured to activate or energize the light emitter 154 if the firearm 160 is detected to have been rotated at a 90-degree angle, such as sideways (e.g., about a longitudinal axis of the firearm 160). Additionally or alternatively, the light emitter 154 may be programmed or configured to enter and remain in a sleep mode as long as the sensor 152 does not detect movement of the firearm 160; once a movement is detected, the light emitter 154 can then enter an active mode in which movement of the firearm 160 in one or more specific, predefined directions will be detected by the sensor 152 and switch on the light emitter 154 accordingly.

At least one power source 150 may be provided in the power source compartment 134 of the sight housing 116. The power source 150 may include at least one battery, solar cell or any combination thereof, for example and without limitation. In some embodiments, a manual switch (not illustrated) may electrically interface with the at least one power source 150 instead of the sensor 152; for example, in some embodiments, operation of the manual switch may allow a user to selectively and manually switch the light emitter 154 on and off. In other embodiments, a manual switch (not illustrated) may electrically interface with the at least one power source 150 in addition to the sensor 152; for example, operation of the manual switch may enable or disable movement detection by the sensor 152 in order to switch the light emitter 154 on. The manual switch may be provided in any suitable accessible location or position on the sight housing 114 or elsewhere on the firearm sight 100 or the firearm 160.

As can be seen in FIGS. 1 and 2, the firearm sight 100 may include a sight mount bracket 102. The sight mount bracket 102 may have any design which is suitable to mount the firearm sight 100 on the firearm 160 (FIGS. 3 and 4). For example and without limitation, in some embodiments, the sight mount bracket 102 may include a bracket plate 104. A pair of spaced-apart, parallel bracket side walls 106 may extend from the bracket plate 104. A pair of bracket flanges 108 may extend inwardly toward each other from the respective bracket side walls 106. Accordingly, the bracket flanges 108 may be suitably configured to detachably or releasably engage a pair of companion flange slots 164 (one of which is illustrated in FIGS. 3 and 4) in the firearm barrel 162 of the firearm 160 to mount the firearm sight 100 on the firearm 160. For instance and without limitation, the bracket flanges 108 may slidably engage the companion flange slots 164. Alternatively or additionally, the bracket flanges 108 may clip onto the companion flange slots 164, such as by having the bracket plate 104 and/or bracket flanges 106 elastically deformable to separate from one another and acquire a more open position relative to one another, and elastically biased to recover an original, less open position in which the bracket flanges 106 are closer to one another than in the more open position.

As further shown in FIGS. 1 and 2, and in the cross-sectional view of FIG. 5, a hollow, sight housing 114 may be provided on the bracket plate 104 of the sight mount bracket 102. The sight housing 114 may contain some or all of the various functional components of the firearm sight 100; for instance, the sight housing 114 of the present embodiment contains all the various functional components of the firearm sight 100, as will be hereinafter described. The sight housing 114 may include a housing bottom 116. A housing mount 126 may attach the housing bottom 116 to the bracket plate 104. A pair of elongated, parallel, spaced-apart left and right housing sides 118 may extend from the housing bottom 116. A housing top 120 may extend between the housing sides 118. A front housing side or end 122 and a rear housing side or end 124 may extend between the housing bottom 116 and the housing top 120 and between the housing sides 118 at opposite ends of the sight housing 114. It must be noted, however, that alternative embodiments of the invention are contemplated in which the sight housing 114 may have alternative structures which are consistent with the functional objectives of the firearm sight 100.

As illustrated in FIG. 5, a first compartment or power source compartment 134, a second compartment or light emitter compartment 136 and a third compartment or light transmitter compartment 138 may be provided in the sight housing 114. In some embodiments, the power source compartment 134 may be above the housing mount 126, the light emitter compartment 136 may be above the power source compartment 134 and the light transmitter compartment 138 may be above the light emitter compartment 136, as illustrated. Accordingly, a lower housing partition 128 may separate the light emitter compartment 136 from the underlying power source compartment 134, and an upper housing partition 130 may separate the light transmission compartment 138 from the underlying light emitter compartment 136.

As further illustrated in FIG. 5, the light transmission compartment 138 may include an opaque access cover 140 having a cover disk 144 at the front housing end 122 and a light emission end 142 at the rear housing end 124 of the sight housing 114. A light transmission medium 146 may fill the light transmission compartment 138 between the light emitter 154 and the light emission end 142, in order to transport light from the light emitter 154 to the light emission end 142; for instance, in the present embodiment, the light transmission medium 146 extends between the opaque access cover 140 and the light emission end 142. The light emission end 142 of the light transmission compartment 138 is open, transparent or translucent, to allow light from the light transmission medium 146 to exit the light transmission compartment 138 and be projected outward and rearward of the rear housing end 124 of the sight housing 114 of the firearm sight 100.

The at least one sensor 152 may electrically interface with the power source 150. In some embodiments, a sensor opening 156 may extend through the lower housing partition 128 between the power source compartment 134 and the light emitter compartment 136. The sensor 152 may extend through the sensor opening 156 and protrude into the power source compartment 134 and the light emitter compartment 136.

The light emitter 154 may electrically interface with the sensor 152. As described heretofore, the light transmission compartment 138 is disposed in light-receiving communication with the light emitter 154. For example and without limitation, in some embodiments, the light emitter 154 may interface with the light transmission compartment 138 through a light emitter opening 132 which may extend through the upper housing partition 130. Accordingly, the light transmission medium 146 in the light transmission compartment 138 may be suitably configured to receive a beam of light (not illustrated) from the light emitter 154 and emit the beam of light from the light emission end 142 at the rear housing end 124 of the sight housing 114. The different electrical components of the firearm sight 100 described heretofore may be electrically interconnected by electrical wires 158.

In an illustrative application, the firearm sight 100 may be mounted on the firearm barrel 162 of the firearm 160 such as by slidable or elastic engagement of the bracket flanges 108 on the sight mount bracket 102 with the respective companion flange slots 164 in the firearm barrel 162, as illustrated in FIGS. 3 and 4. As the firearm sight 100 is mounted on the firearm barrel 162, the firearm sight 100 may be oriented such that the cover disk 144 on the access cover 140 in the light transmission compartment 138 faces forwardly, as illustrated in FIG. 3, and the light emission end 142 of the light transmission compartment 138 faces rearwardly, as illustrated in FIG. 4, toward a firearm shooter (not illustrated) as the shooter aims the firearm 160.

In the event that the sensor 152 senses motion of the firearm 160, the sensor 152 may close a circuit (not illustrated) between the power source 150 and the light emitter 154. Accordingly, electrical current may flow from the power source 150 to the light emitter 154, which may emit a beam of light into the light transmission medium 146 through the light emitter opening 132 in the upper housing partition 130. The light transmission medium 146 may emit the beam of light from the light transmission compartment 138 through the light emission end 142 towards the eye of the firearm shooter (not illustrated). In some embodiments, the access cover 140 and cover disk 144 may not be opaque, and the light transmission medium 146 may additionally emit the beam of light from the light transmission compartment 138 through the access cover 140 and cover disk 144. Accordingly, the firearm shooter may view and aim the beam of light towards the target, thereby aiming the firearm 160. As long as the sensor 152 detects movement or changes in orientation of the firearm 160, the sensor 152 may continue to maintain the circuit between the power source 150 and the light emitter 154 in the closed position to sustain emission of the light beam from the light emission end 142 of the light transmission medium 146.

In the event that the sensor 152 does not sense movement of the firearm 160 for a predetermined period of time preferably greater than zero, as may occur if the firearm 160 is placed aside, for example, the sensor 152 may open the circuit between the power source 150 and the light emitter 154, terminating emission of the light beam from the light emission end 142 of the light transmission compartment 138. Alternatively or additionally, the sensor 152 may open the circuit between the power source 150 and the light emitter 154 when a specific type of movement is detected. In other embodiments, the sensor 152 may open the circuit between the power source 150 and the light emitter 154 when the movement that activated the light emitter 154 (i.e. closed the circuit) is ceased to be detected (e.g., when the sensor 152 stops detecting a sideways 90-degree rotation of the firearm sight 100). The light emitter 154 may enter and remain in a sleep mode as long as the sensor 152 does not detect movement of the firearm 160. The sensor 152 may subsequently again activate or energize the light emitter 154 when any motion of the firearm 160 is detected.

Figure 6:
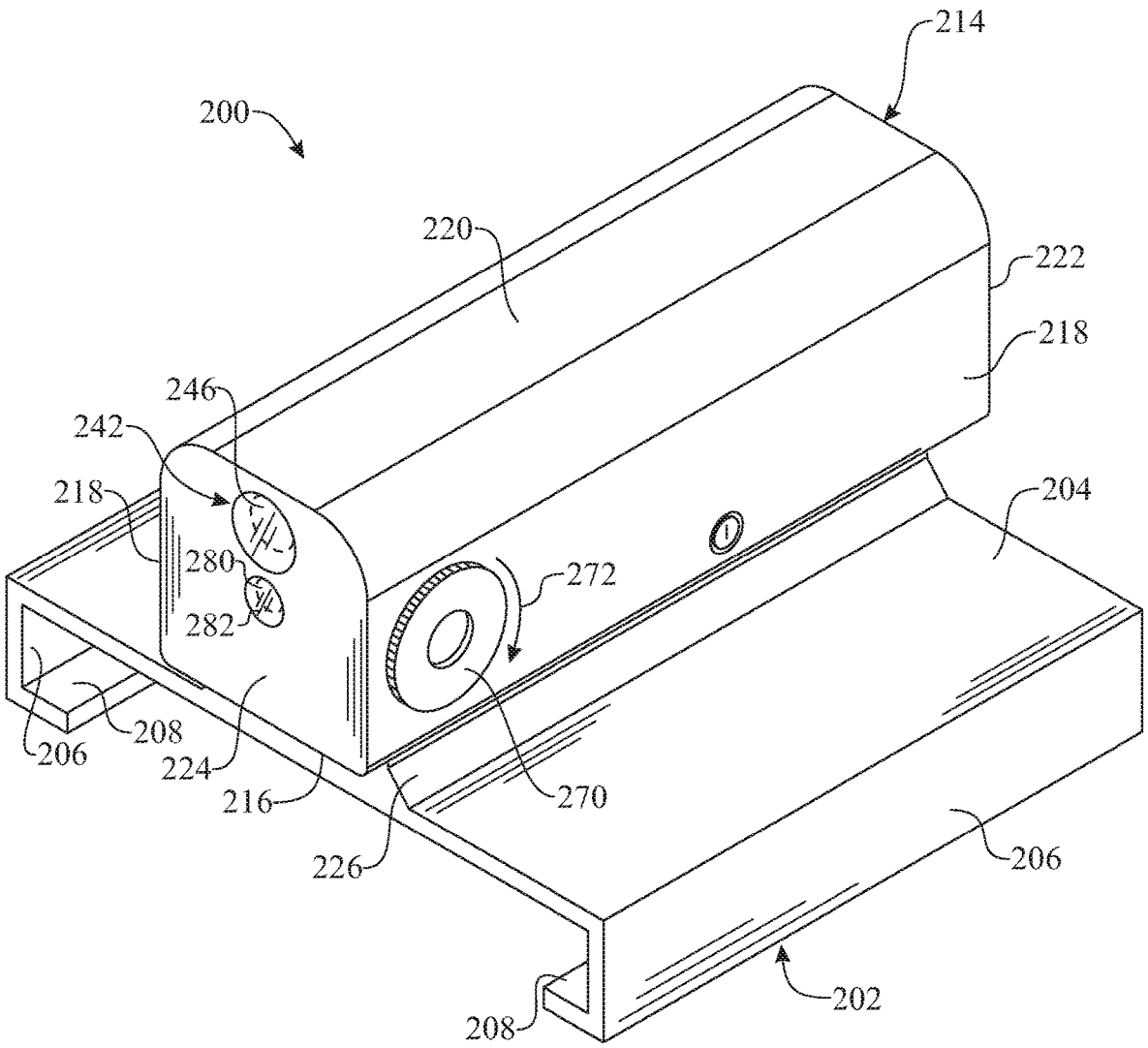
FIG. 6 presents a top rear perspective view of a firearm sight in accordance with a second illustrative embodiment of the present invention.
Figure 7:
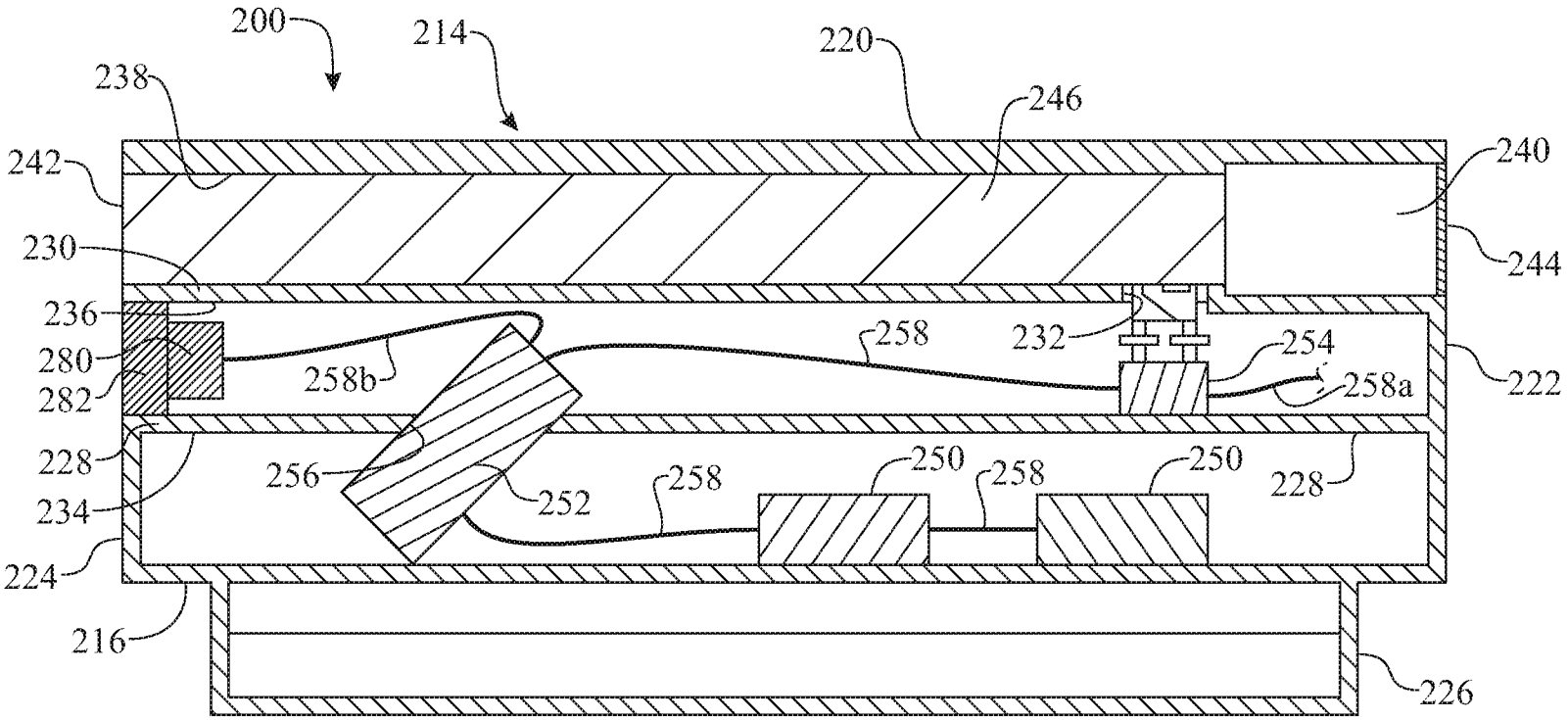
FIG. 7 presents a cross-sectional side elevation view of the firearm sight of FIG. 6, showing internal components of the sight, wherein the cross section has been carried out similarly to that of FIG. 5.

The illustrations of FIGS. 6 and 7 show a second illustrative embodiment of the firearm sight, which is generally indicated by reference numeral 200. Similarly to the previous embodiment, the firearm sight 200 may be suitably configured to be mounted on a firearm (such as, but not limited to, the firearm 160 depicted in FIGS. 3 and 4).

As shown in FIG. 6, and in the cross-sectional view of FIG. 7, the firearm sight 200, similarly to the previous embodiment, comprises a sight mount bracket 202 including a bracket plate 204, a pair of spaced-apart, parallel bracket side walls 206, and a pair of bracket flanges 208. A hollow, sight housing 214 is carried by a housing mount 226 provided on the bracket plate 204. The sight housing 214 comprises a housing bottom 216, left and right housing sides 218, a housing top 220, a front housing side or end 222 and a rear housing side or end 224. The housing bottom 216 is attached to the housing mount 226 of the bracket plate 204. Similarly to the previous embodiment, alternative embodiments are contemplated in which the sight housing 214 may have alternative structures which are consistent with the functional objectives of the firearm sight 200.

Also similarly to the previous embodiment, as shown in FIG. 7, the sight housing 214 is provided with three internal compartments: a first compartment or power source compartment 234, a second compartment or light emitter compartment 236 and a third compartment or light transmitter compartment 238, which can be arranged in a vertically-stacked configuration, with the power source compartment 234 located at the bottom, the light emitter compartment 236 in the middle, and the light transmitter compartment 238 at the top, as illustrated. Lower and upper housing partitions 228 and 230 separate the first, second and third compartments 234, 236, and 238. The light transmission compartment 238 may include an access cover 240 which may end in a cover disk 244 at the front housing end 222 and a light emission end 242 at the rear housing end 224 of the sight housing 214. A light transmission medium 246 may fill the light transmission compartment 238 between a light emitter 254 (located in the light emitter compartment 236 and configured to emit visible light into the light transmission compartment 238 via a light emitter opening 232 formed in the upper housing partition 230) and the light emission end 242, in order to transport light from the light emitter 254 to the light emission end 242; for instance, similarly to the previous embodiment, the light transmission medium 246 of the present embodiment extends between the access cover 240 and the light emission end 242. The light emission end 242 of the light transmission compartment 238 can be open, transparent or translucent, to allow light from the light transmission medium 246 to exit the light transmission compartment 238 and be projected outward and rearward of the rear housing end 224 of the sight housing 214 of the firearm sight 200. In turn, the access cover 240 and cover disk 244 may be opaque or non-opaque.

Also similarly to the previous embodiment, the firearm sight 200 includes at least one sensor 252 which may be programmed or configured to activate or energize the light emitter 254. In the non-limiting example shown in the drawing, the at least one sensor 252 is arranged in the power source compartment 234 and light emitter compartment 238 and extends through a sensor opening 256 in the lower housing partition 228. At least one power source 250 may be provided in the power source compartment 234 of the sight housing 216, configured to operate the electrical components of the firearm sight 200, similarly to the previous embodiment. Similarly to the previous embodiment, the different electrical components of the firearm sight 200 may be electrically connected by electrical wires 258. Unless expressed otherwise hereinafter, operation of the at least one sensor 252, light emitter 254, at least one power source 250, and an optional manual switch (not shown) may be the same as described heretofore with respect to the at least one sensor 152, light emitter 154, at least one power source 150, and the optional manual switch (not shown) of the first embodiment.

The firearm sight 200 of the present embodiment further includes a user-operable control 270 operable by a user's hand (not shown) to manually adjust the brightness the light emitted by the light emitter 254. The user-operable control 270 may electrically interface with the light emitter 254 via an electrical wire 258*a* of the plurality of electrical wires 258 included in the firearm sight 200, in order to vary the brightness of the light emitter 254 directly, for instance and without limitation. However, alternative electrical implementations are contemplated without departing from the scope of the present disclosure; for instance and without limitation, the user-operable control 270 may electrically adjust the electrical power provided by the at least one power source 250 to the light emitter 254, such as via a potentiometer. It must be noted that the user-operable control 270 depicted herein is a rotary disk rotatably carried by the sight housing 214, as indicated by arrow 272; however, alternative embodiments are contemplated in which the user-operable control may include a lever, button or other manually-movable part.

Furthermore, the firearm sight 200 of the present embodiment comprises at least one infrared-light emitter 280 (e.g., an infrared LED) to allow for night vision compatibility. The infrared-light emitter 280 can interface with the at least one sensor 252 via an electrical wire 258*b* of the plurality of electrical wires 258 thus be operated responsively to operation of the at least one sensor 252 similarly to the light emitter 254 (and thus similarly to the light emitter 154 of the first embodiment). In some embodiments, the at least one infrared-light emitter 280 may be located at the rear housing end 224, such as, but not limited to, at the rear end of the light emitter compartment 236. Alternatively or additionally, the at least one infrared-light emitter may be located at the front housing end 222, such as, but not limited to, at the front end of the light emitter compartment 236, in order for the at least one front, infrared-light emitter to illuminate an area located frontward of the user holding the firearm. In some embodiments, the front or rear, at least one infrared-light emitter 280 may be optionally located internally of a transparent or translucent infrared-light emitter cover 282 which may protect the at least one infrared-light emitter 280.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A firearm sight for use with a firearm to facilitate ease and accuracy in aiming the firearm by a firearm shooter, comprising:

a sight housing configured to be attached on top of and adjacent to a discharge end of a barrel of the firearm, the sight housing including a front housing end and a rear housing end oriented towards a front end and a rear end of the firearm, respectively;

a light emission end disposed at the rear housing end the sight housing;

at least one visible light emitter carried by the sight housing;

at least one sensor carried by the sight housing and configured to detect at least one of a motion, a change in position or a change in orientation of the sight housing;

at least one power source carried b the sight housing; wherein the at least one visible light emitter is switchable to an activated status responsively to the at least one sensor detecting a motion, a change in position or a change in orientation of the sight housing, wherein, in the activated status, the at least one visible light emitter is powered by the at least one power source and emits a visible light beam out of the sight housing through the light emission end disposed at the rear housing end of the sight housing rearward towards the firearm shooter; and at least one infrared light emitter carried by the sight housing, wherein the at least one infrared light emitter is switchable to an activated status responsively to the at least one sensor detecting a motion, a change in position or a change in orientation of the sight housing, wherein, in the activated status, the at least one infrared light emitter is powered by the at least one power source and emits an infrared light beam out of the sight housing through the front housing end to illuminate an area located frontward of the firearm shooter.

2. The firearm sight of claim 1, wherein the at least one visible light emitter is arranged inside the sight housing.

3. The firearm sight of claim 1, wherein the at least one sensor is arranged inside the sight housing.

4. The firearm sight of claim 1, wherein the at least one power source is arranged inside the sight housing.

5. The firearm sight of claim 1, further comprising a light transmission medium extending between the at least one visible light emitter and the rear end of the sight housing.

6. The firearm sight of claim 5, wherein the sight housing comprises a power source compartment housing the at least one power source, a light emitter compartment housing the at least one visible light emitter, and a light transmission compartment housing the light transmission medium.

7. The firearm sight of claim 6, wherein the compartments are arranged in a vertically-stacked configuration, with the power source compartment arranged closest, to the firearm, the light transmission compartment arranged farthest to the firearm, and the light emitter compartment arranged between the power source compartment and the light transmission compartment.

8. The firearm sight of claim 1, wherein the light emitters are switchable to a deactivated status responsively to the at least one sensor not detecting a motion, a change in position or a change in orientation of the sight housing for a predetermined period of time, wherein the light emitters do not emit light when in the deactivated status.

9. The firearm sight of claim 8, wherein the predetermined period of time is greater than zero.

10. The firearm sight of claim 8, wherein the firearm sight is configured such that the light emitters remain in the deactivated status as long as the at least one sensor does not detect a motion, a change in position or a change in orientation of the sight housing, and wherein the firearm sight enters an awake status once the at least one sensor detects a motion, a change in position or a change in orientation of the sight housing, and further wherein the light emitters are switchable to the activated status when the at least one sensor of the firearm sight in the awake status detects a predetermined motion, predetermined change in position or predetermined change in orientation of the sight housing.

11. The firearm sight of claim 1, further comprising a sight mount bracket carrying the sight housing and configured to mount the firearm sight on the firearm.

12. The firearm sight of claim 1, further comprising a user-operable control configured to adjust a brightness of the at least one visible light emitter responsively to manual operation of the user-operable control.

13. A firearm sight, for use with a firearm to facilitate ease and accuracy in aiming the firearm by a firearm shooter, comprising:

a sight housing configured to be attached on top of and adjacent to a discharge end of a barrel of the firearm, the sight housing including a front housing end and a rear housing end oriented towards a front end and a rear end of the firearm, respectively;

at least one visible light emitter inside the sight housing;

a light emission end disposed at the rear housing end of the sight housing;

at least one sensor inside the sight housing and configured to detect at least one of a notion, a change in position or a change in orientation of the sight housing;

at least one power source inside the sight housing; wherein the at least one visible light emitter is switchable to an activated status responsively to the at least one sensor detecting a motion, a change in position or a change in orientation of the sight housing, wherein, in the activated status, the at least one emitter is powered by the at least one power source and emits a visible light beam out of the sight housing through the light emission end disposed at the rear housing end of the sight housing rearward towards the firearm shooter;

the sight housing comprising a power source compartment housing the at least one power source, a light emitter compartment housing the at least one visible light emitter, and a light transmission compartment housing a light transmission medium, arranged in a vertically-stacked configuration with the power source compartment located at the bottom adjacent the firearm, the light emitter compartment in the middle, and the light transmitter compartment at the top; and at least one infrared light emitter carried by the sight housing, wherein the at least one infrared light emitter is switchable to an activated status responsively to the at least one sensor detecting a motion, a change in position or a change in orientation of the sight housing, wherein, in the activated status, the at least one infrared light emitter is powered by the at least one power source and emits an infrared light beam out of the sight housing through the front housing end to illuminate an area located frontward of the firearm shooter, the at least one infrared light emitter positioned internally of a translucent infrared light emitter cover over a portion of the front housing end to protect the at least one infrared light emitter disposed therein.

14. A firearm sight for use with a firearm to facilitate ease and accuracy in aiming the firearm by a firearm shooter, comprising:

a sight housing configured to be attached on top of and adjacent to a discharge end of a barrel of the firearm, the sight housing including a front housing end and a rear housing end oriented towards a front end and a rear end of the firearm, respectively;

at least one visible light emitter inside the sight housing;

a light transmission medium arranged inside the sight housing and extending between the at least one visible light emitter and the rear end of the sight housing;

a light emission end disposed at the rear housing end of the sight housing;

at least one sensor inside the sight housing and configured to detect at least one of a motion, a change in position or a change in orientation of the sight housing;

at least one power source inside the sight housing; wherein the at least one visible light emitter is switchable to an activated status responsively to the at least one sensor detecting a motion, a change in position or a change in orientation of the sight housing, wherein, in the activated status, the at least one visible light emitter is powered by the at least one power source and emits a visible light beam from the light transmission medium out of the light emission end disposed at the rear housing end of the sight housing rearward towards the firearm shooter;

the sight housing comprising a power source compartment housing the at least one power source, a light emitter compartment housing the at least one visible light emitter, and a light transmission compartment housing the light transmission medium, arranged in a vertically-stacked configuration with the power source compartment located at the bottom adjacent the firearm, the light emitter compartment in the middle, and the light transmitter compartment at the top; and least one infrared light emitter carried by the sight housing, wherein the at east one infrared light emitter is switchable to an activated status responsively to the at least one sensor detecting a motion, a change in position or a change in orientation of the sight housing, wherein, in the activated status, the at least one infrared light emitter is powered by the at least one power source and emits an infrared light beam out of the sight housing through the front housing end to illuminate an area located frontward of the firearm shooter, the at least one infrared light emitter positioned internally of a translucent infrared light emitter cover over a portion of the front housing end to protect the at least one infrared light emitter disposed therein.

* * * * *